United States Patent [19]

Wild

[11] 4,033,095

[45] July 5, 1977

[54] NECK-DOWN BOTTLE PACKING GRID

[76] Inventor: Anton J. Wild, 310 Springfield Ave., Westfield, N.J. 07092

[22] Filed: Sept. 8, 1976

[21] Appl. No.: 721,269

[52] U.S. Cl. ..... 53/248; 53/262

[51] Int. Cl.[2] ..... B65B 39/02

[58] Field of Search ..... 53/247, 249, 262, 263, 53/166, 393; 193/7, 25 R, 25 E, 25 S, 32

[56] References Cited

UNITED STATES PATENTS

| | | | |
|---|---|---|---|
| 3,788,034 | 1/1974 | Hartness et al. | 53/248 |
| 3,911,647 | 10/1975 | Hartness et al. | 53/248 |
| 3,922,836 | 12/1975 | McGill | 53/248 |

*Primary Examiner*—Robert Louis Spruill
*Attorney, Agent, or Firm*—Sperry and Zoda

[57] ABSTRACT

A neck-down bottle packing grid which eliminates glass to metal contact between the packing apparatus and the glass bottles which includes a plurality of partitions extending approximately parallel with respect to one another having guiding blocks, deflectors or doghouses of nylon or some other soft material equally spaced along the upper edges thereof, these deflectors being fixedly mounted upon deflector or doghouse mounts firmly secured to the upper edge of the partitions, also including a plurality of finger blocks extending downwardly on both sides of the partitions below each doghouse location, the finger blocks including two outwardly facing guide surfaces which taper downwardly and obliquely outwardly away from the partitions to define in combination with adjacent partition and guide surfaces a plurality of bottle receiving cells for sorting the downwardly moving bottles into an array for direct placement into a case or the like, in order to prevent glass to metal contact a plurality of covers of soft material are secured upon the guide surfaces of the finger mounting blocks and a plurality of inserts of soft material are positioned above the upper edges of each section of the partitions.

14 Claims, 10 Drawing Figures

NECK-DOWN BOTTLE PACKING GRID

BACKGROUND OF THE INVENTION

1. Field of the Invention

The present invention pertains to the field of bottling grid in which it is desirable to orient bottles in an orderly array within a bottle carrying case or the like. Although the present design is particularly adaptable for use with a bottle grid requiring the bottles to be packed in an inverted position, it should be appreciated that the present design may be utilized with any type of bottle orientation.

The present grid is usable to place randomly fed bottles in an orderly array. These bottles tend to be quite heavy and therefore require a sturdy apparatus which minimizes chipping of the bottles as they pass through the grid. However, when a bottle packing grid of sufficient strength is used the chipping between the metal and glass is almost impossible to eliminate and therefore the present design has provided a system for eliminating the glass to metal contact by including deflectors, doghouses or pagodas, covers on the guilding surfaces, downwardly extending flexible fingers and inserts all formed from a soft material such as nylon, teflon, plastic, or the like. With this configuration the chipping which has long been a problem in this field of art is eliminated.

2. Description Of The Prior Art

Many devices have been utilized for orienting bottles into an orderly array for placement into bottle carrying cases and the like. However none have been devised which eliminate the glass to metal contact and provide for a smooth downwardly flowing bottle orientation to register with the axis of the cells of the case. U.S. Pat. No. 3,142,141 is an example of such a bottle packing machine which includes the downwardly extending fingers but utilizes partitions extending in two directions perpendicular to one another to present the array of cells into which the bottles are guided. The present packing grid utilizes partitions extending only in a single direction and the orderly array is created by the adjacent positioning of the guide surfaces of the finger mounting blocks. The Walter design does not eliminate the glass to metal contact and, as such, the inherent problem of chipping of the glass bottles is not overcome as in the present invention.

Other patents such as U.S. Pat. Nos. 3,271,928 and 2,686,632 and 2,727,664 provide devices for packing bottles. However none of these designs include the plurality of soft inserts along the upper edge of the partitioning means as well as the guiding surfaces of the present invention which provide the flush condition for the smooth transition of the bottles as soon as they have passed the doghouses and upper edges of the partitions. Also many of these designs utilize fingers extending downwardly from the upper edge of the partitions such that the finger material bends at a sharp angle which is impacted by the downwardly moving bottles. In this configuration the sharp angles of bending of the finger over the partition provides an inherent weakened area which provides a maintenance problem due to frequent breakage of the fingers at this location. The present invention includes singly mounted fingers which are fixedly secured in place by the nylon covers and do not include sharp bending angles which thereby eliminates the finger breakage problem. In this manner the fingers of the present design are protected from breakage by the nylon cover plates.

Other designs have also utilized rigid guiding elements whereas the present invention includes a movable deflector or guiding block which may be pivotally or otherwise movably secured to the partition means to prevent chipping of downwardly moving bottles when they contact the doghouse with hard impact. Also the nylon inserts have a slight degree of lateral movement to allow for minimal flexing in response to a high impact between the downwardly moving bottles and the inserts.

SUMMARY OF THE INVENTION

The packing grid of the present invention provides a neck-down bottle packing system which eliminates metal to glass contact between the packing apparatus and the glass bottles. In an embodiment a plurality of partitions extend approximately parallel with respect to one another and include positioned thereon a plurality of deflectors of soft material such as nylon or the like. These deflectors or doghouses are preferably located at fixed distances with respect to one another to present an array of cells between adjacent doghouses. One each opposite surface of the partitions below each doghouse location will be located a downwardly extending finger block which is adapted to have secured thereto fingers extending further downwardly therefrom. The finger blocks are secured to the partitions below each doghouse to present downwardly and outwardly extending guiding surfaces which taper away from the partition to aid in defining adjacent bottle receiving cells. The fingers are fixedly secured to each guiding surfaces and extend downward therefrom and inward toward the axis of each adjacent cell. This configuration therefore defines cells which are bounded by two surfaces of adjacent partitions and four guiding surfaces of finger blocks mounted at the corners of the cells. The corners of each cell will include a deflector at the upper edges of the partitions to facilitate the guiding of downwardly movig neck-down bottles into initial orientation within the cells.

To minimize glass to metal contact between the downwardly moving bottle and the packing apparatus, an insert of nylon, teflon or other soft material may be positioned along the upper edges of the partitions. Also the deflectors are preferably formed of a similar soft material as well as are the fingers which are preferably of nylon. To eliminate the metal to glass contact between the finger blocks and the bottles a cover is fixedly secured upon the guiding surfaces of the finger blocks which provides a smooth surface of transition for the downwardly moving bottle from the doghouses to the fingers.

Each cell therefore is further defined by nylon fingers extending inwardly toward the axis of the cell from each corner of the cell. These nylon fingers aid in guiding the bottle into perfect orientation within the cell. In order to increase the bias directed inwardly toward the axis of the cell by the nylon fingers, a finger biasing means such as a flat spring or the like may be in contact with the rear surface of the nylon fingers to urge them inwardly and thereby increase the bias. Another aid in guiding the bottles into perfect orientation within the cells may be a movably mounted deflector. This deflector or doghouse may be secured to a doghouse mount which may be movably secured to a doghouse base fixedly attached to the upper edges of the partitions at each doghouse location. In this manner a pin device or other pivotally movable device may connect the doghouse mount with the doghouse bases to allow slight movement of the doghouse when receiving a strong impact from a downwardly moving bottle. In this manner the doghouse will move slightly to yield somewhat and prevent damage or chipping to the glass bottles.

The nylon inserts may be fixed in place by an insert retaining means of various configurations. In particular the deflectors may define slots therein into which the inserts may be located to retain them in place adjacent the upper edges of the partitions. In this manner each insert section extending from one doghouse to the next doghouse will be maintained in position by the slots in the adjacent doghouses. In another configuration a plate member may be secured to the partition or the doghouse base to extend over both sides of the insert to maintain it in perfect orientation adjacent the upper edge of the partition. Another means of retaining the insert in position above the partition would be a tongue-and-groove interconnecting design in which a groove is positioned in either the insert or the upper edge of the partition complementary with a tab or tongue means in the opposite part to allow fixed connection between the upper edge of the partition and the nylon insert.

With this configuration the combination of the insert, the doghouse, the cover and the nylon fingers all formed from a soft material will provide a flush downward profile or condition for a smooth transition of the bottles into the case therebelow as soon as they have passed the upper edges of the partitions. Also this design will prevent breakage of fingers due to the protection afforded by the nylon cover members, and most importantly the glass to metal contact inherent in the bottle packing systems of the prior art is eliminated by the various components of nylon or other soft material.

It is an object of the present invention to provide a bottle packing grid which eliminates contact between the metal of the bottling machinery and the glass of the bottles.

It is an object of the present invention to provide a neck-down bottle packing grid in which all parts of the bottle machinery contacting the glass bottles are formed of nylon.

It is an object of the present invention to provide a bottle packing grid which is simple, inexpensive and requires little maintenance.

It is an object of the present invention to provide a bottle packing grid in which the operating lifetime of guiding fingers is considerably increased.

It is an object of the present invention to provide a bottle packing grid which prevents chipping of bottles moving therethrough.

It is an object of the present invention to provide a bottle packing grid which includes movably mounted guiding blocks or deflectors for urging the downwardly moving bottles into registration within adjacent cells.

It is an object of the present invention to provide a bottle packing grid capable of utilization with a variety of bottle diameters.

It is a object of the present invention to provide a bottle packing grid which includes easily replaceable inserts and fingers. It is an object of the present invention to provide a bottle packing grid which presents a flush guiding face for the smooth transition of bottles as they pass by the deflectors and the guiding fingers.

It is an object of the present invention to provide a bottle packing grid which assures accurate vertical alignment of the guiding surfaces and the deflectors or guiding blocks.

It is an object of the present invention to provide a bottle packing grid of strong construction which is capable of usage with smaller and larger bottle masses.

BRIEF DESCRIPTION OF THE DRAWINGS

While the invention is particularly pointed out and distinctly clailmed in the concluding portions herein, a preferred embodiment is set forth in the following detailed description which may be best understood when read in connection with the accompanying drawings, in which.

DETAILED DESCRIPTION OF THE PREFERRED EMBODIMENT

Figure 1:
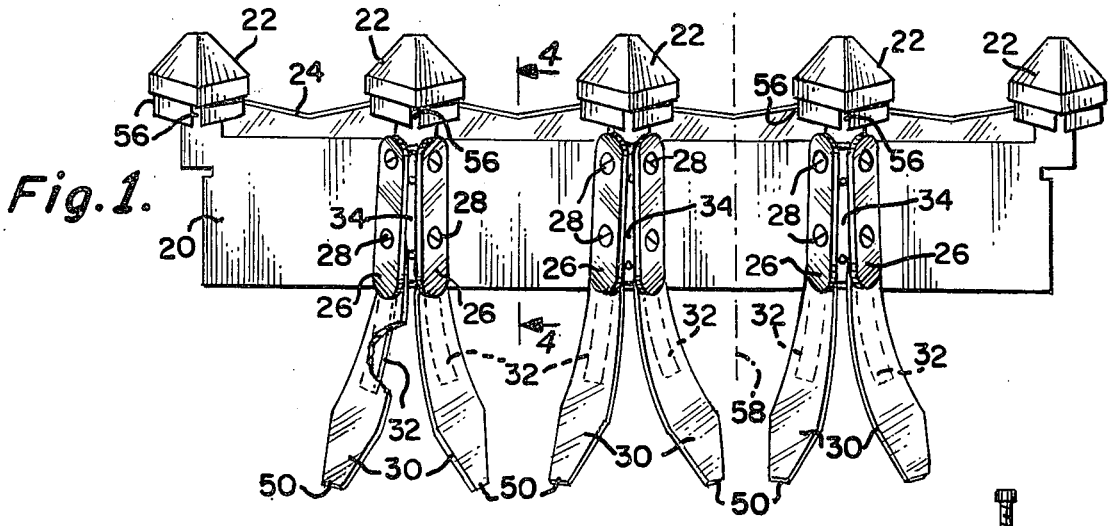
FIG. 1 is a front view of an assembled partition construction of an embodiment of the present invention.

The present invention provides a neck-down bottle packing apparatus which guides randomly oriented neck-down bottles into orderly arrays for placement into bottle carrying cases and the like. The present invention minimizes chipping normally occurring during the entering of the bottles into the grid due to the metal to glass contact between the bottle packing apparatus and the glass bottles. The present bottle packing grid defines an array of bottle receiving cells 42 between a plurality of partitions 20. The partitions 20 are longitudinal metal structures placed approximately parallel to one another and including a plurality of doghouses or main bottle separating blocks along upper edge thereof. Each doghouse 22 is spaced approximatey equal from the adjacent doghouses and is secured upon a doghouse mount 40. The doghouse mount 40 may be movably or fixedly secured to the deflector 22 to maintain the relative orientation between the guiding surfaces thereof.

Figure 2:
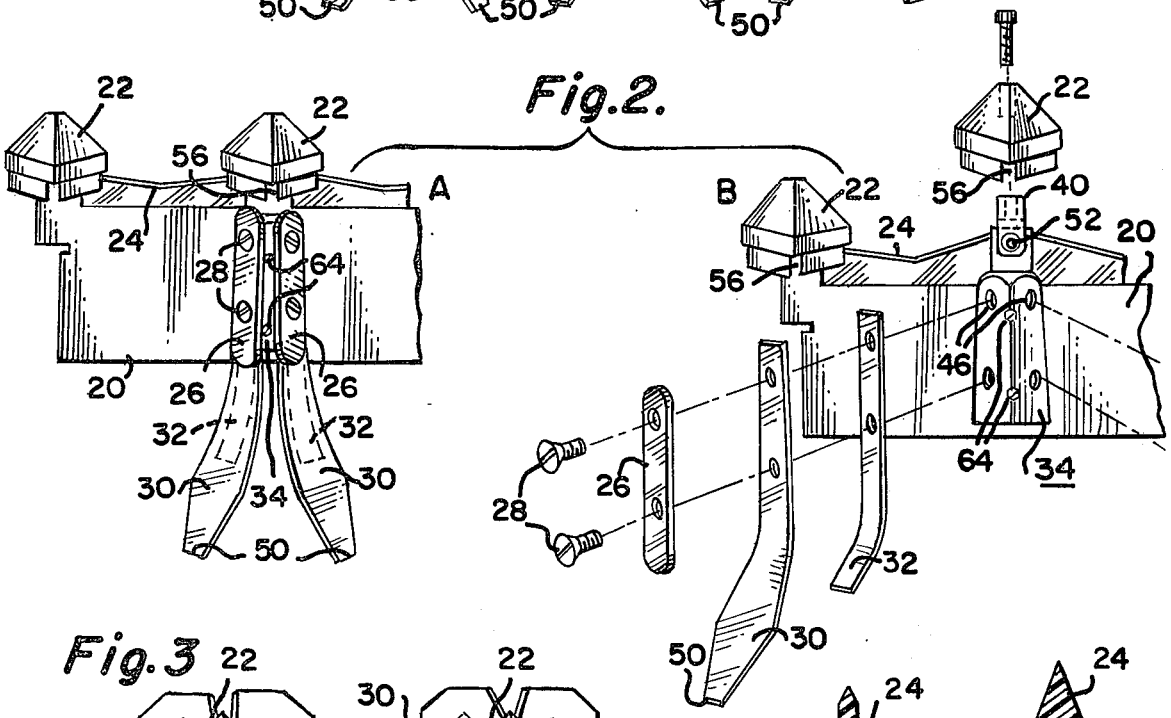
FIG. 2 is an exploded view of the finger block mounting assembly of an embodiment of the present invention.
Figure 3:
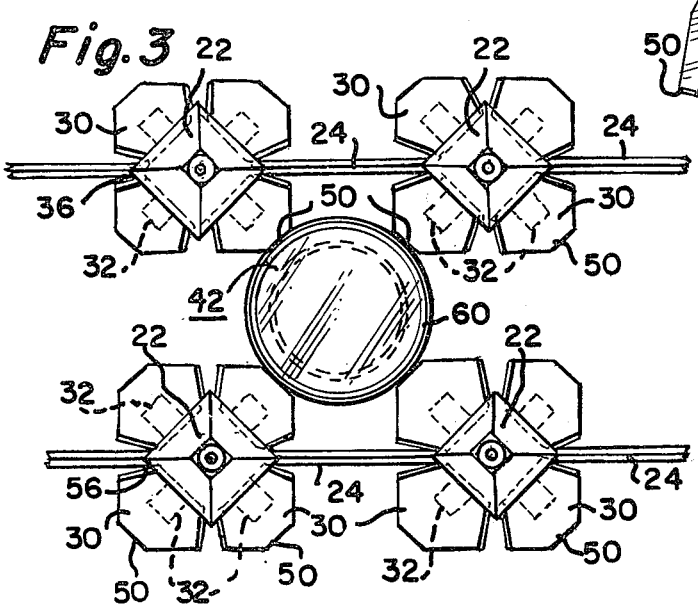
FIG. 3 is a top plan view of a cell defined by the present invention.
Figure 4:
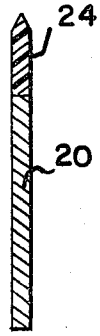
FIG. 4 is a cross-sectional view of FIG. 1 taken through lines 4—4.

A finger mounting block 34 is located on each side of the partition 20 at each location of the doghouses 22. The finger mounting blocks are generally long triangular configurations which slope downwardly and away from the partition 20. This downwardly and outwardly sloping surface is defined as guide surface 44. The guide surfaces define finger block mounting holes 46 therein to facilitate the mounting of covers 26 upon guide surfaces 44. As shown in FIG. 2 cover screws 28 may be usable to secure the cover members 26 to the holes 46 defined by guiding surfaces 44.

Preferably a plurality of fingers 30 are fixedly secured at the upper ends thereof to the finger mounting blocks 34 and include a lower section 50 which is biased outwardly away from the partitions 20 and toward the axis 58 of cells 42. Each cell is defined by two adjacent partition sections and four guiding surfaces 44 as well as four downwardly extending fingers 30. In this manner each cell is adapted to receive a single downwardly moving bottle 60 therein. Four identical guiding surfaces are provided at each corner of the cell 58. These entire guiding surfaces comprise firstly the deflector 22 which may be a pyramidal construction to provide surfaces adapted to guide the bottle inwardly toward the center of the cell. Secondly the cover member 26 is adapted to further guide the bottle 60 toward the center of the cell by fact of the guiding surface 44 which urges the bottle toward the axis of the cell. Finally the four downwardly extending fingers 30 and lower finger sections 50 are adapted to urge the bottle into perfect orientation within the cell. In this manner a smooth transition of the bottles as they pass the deflectors is achieved for alignment for entry into the assigned cell. This entire movement is made possible without any glass to metal contact between the bottle packing grid and the downwardly moving glass bottle.

Figure 5:
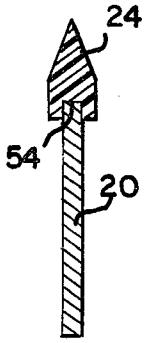
FIG. 5 is another embodiment of the insert and partition configuration of the present invention.
Figure 6:
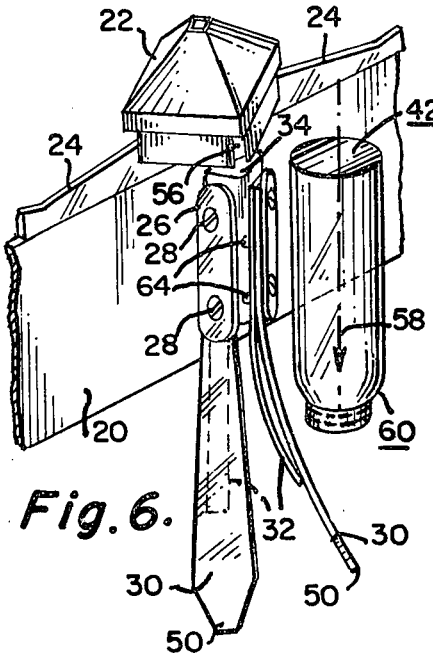
FIG. 6 is a perspective view of the assembled guiding faces of an embodiment of the present invention.
Figure 7:
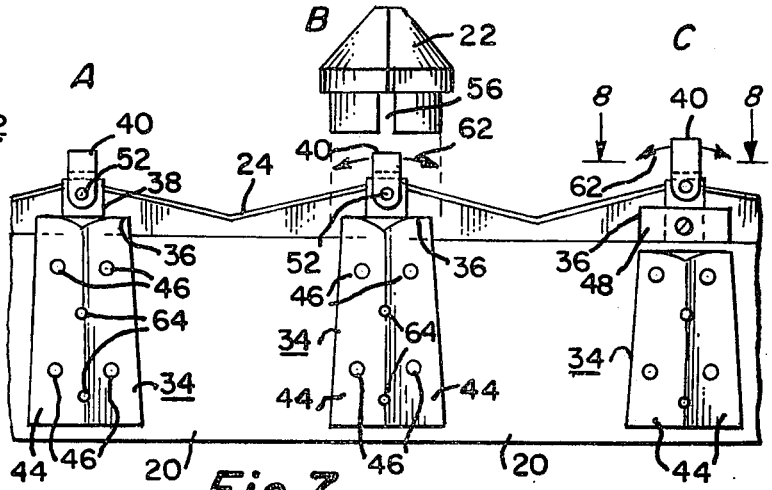
FIG. 7 is a front view showing several embodiments of the doghouse mount of an embodiment of the present invention.
Figure 8:
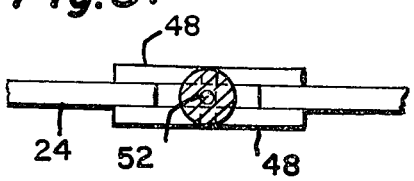
FIG. 8 is a top plan view of an embodiment of the insert retaining plates of the present invention.

To eliminate contact between the downwardy moving bottle and the upper edge of partition 20 a plurality of inserts 24 are positioned along the upper edges of the partitions. These inserts 24 are maintained along the upper edge of the partition 20 by insert retaining means 36 which may be of a variety of different configurations. In one configuration the end sections of the inserts 24 extending between adjacent deflectors will extend into slots 56 defined within the adjacent deflectors 22 to thereby be retained in place as long as the deflector remains in position. In another configuration as shown in FIG. 5 the insert 24 may include a groove 54 therein adapted to receive the upper edge of the partition 20. In this tongue-in-groove configuration the insert 24 will be rigidly held along the upper edge of partition 20. On the other hand the upper edge of the partition could include a groove adapted to receive a tongue formed in the insert (not shown). In yet another embodiment as shown in FIGS. 7C and 8, a plate member 48 may be secured to the partition or the doghouse base 38 and extend over the edges of adjacent inserts 24 to thereby maintain them in place. A plate member 48 should be positioned on both sides of the doghouse base to assure firm retaining of the insert.

In another configuration of the present invention it may be desirable to alow slight movement of the doghouses 22 or guiding blocks to prevent damage to bottles during hard impacts against the doghouses. In this manner a pin 52 may be utilized to provide pivotal securement between doghouse bases 38 and doghouse mounts 40. In this manner as shown by arrows 62 a slight pivotal movement between bases 38 and mounts 40 is made possible.

In order to assure proper orientation of the bottles along the axis 58 of the cells 42 it may be desirable to increase the bias directed inwardly toward the axis 58 by the finger lower sections 50. To achieve this desired purpose a biasing means may abut the undersurface of fingers 30. Such a biasing means may take the form of a flat spring means 32 fixedly secured to the finger mounting block 34 and abutting the rear surface of fingers 30 to thereby urge the fingers toward the cell axis 58 and assure proper orientation of bottles moving through the bottle packing apparatus. These flat springs 32 may be designed with the proper tension to reduce the velocity of the downwardly moving bottle and to insure the prevention of hazardous impact into the carton therebelow.

Of the many advantages of the present design the most important is the elimination of chipping as a result of the nylon deflectors 22 positioned adjacent the inlaid nylon inserts or strips 24. In this manner glass to metal contact is eliminated. Also the spring-backed fingers on the corners of the cells 42 create a smooth transition of the bottles into the cells in perfect alignment. Present designs utilized in neckdown bottling do not include the advantages of the present design, because of extensive chipping caused by glass to metal contact and frequent breakage of the downwardy extending fingers 30. Elimination of finger breakage problems is achieved in the present design by the fixedly positioned covers 26 extending covers over the finger blocks 34 to eliminate direct impact of the bottles against the fingers 30. In this manner better alignment of the bottles within the cells is achieved as well as better control of the bottle as it is moving downwardly toward the point of orientation within the cells. Also the present design has the adaptability for use with bottles of various diameters without requiring any changes to the apparatus. Also since the doghouses 22 are easily removable the inserts between adjacent doghouses are also easily removable and may be replaced with a minimum of maintenance costs. Another important advantage of the present design when pin 52 is utilized to interconnect doghouse bases 38 and doghouse mounts 40, is the perfect vertical alignment which is made possible between the two mounting screws 64 which mount the finger block 34 to the partition 20 and the mounting location of the doghouses. This perfect orientation is not possible when the interconnection between the doghouses bases 38 and the doghouse mount 40 is achieved by welding. Therefore when utilizing the pinned interconnection therebetween an accurate orientation is achieved which assures proper cell alignment.

Figure 9:
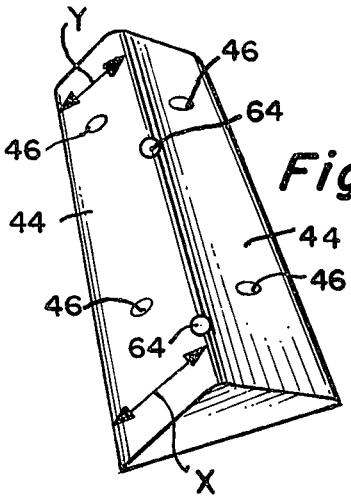
FIG. 9 is a perspective view of an embodiment of the finger mounting block of the present invention.
Figure 10:
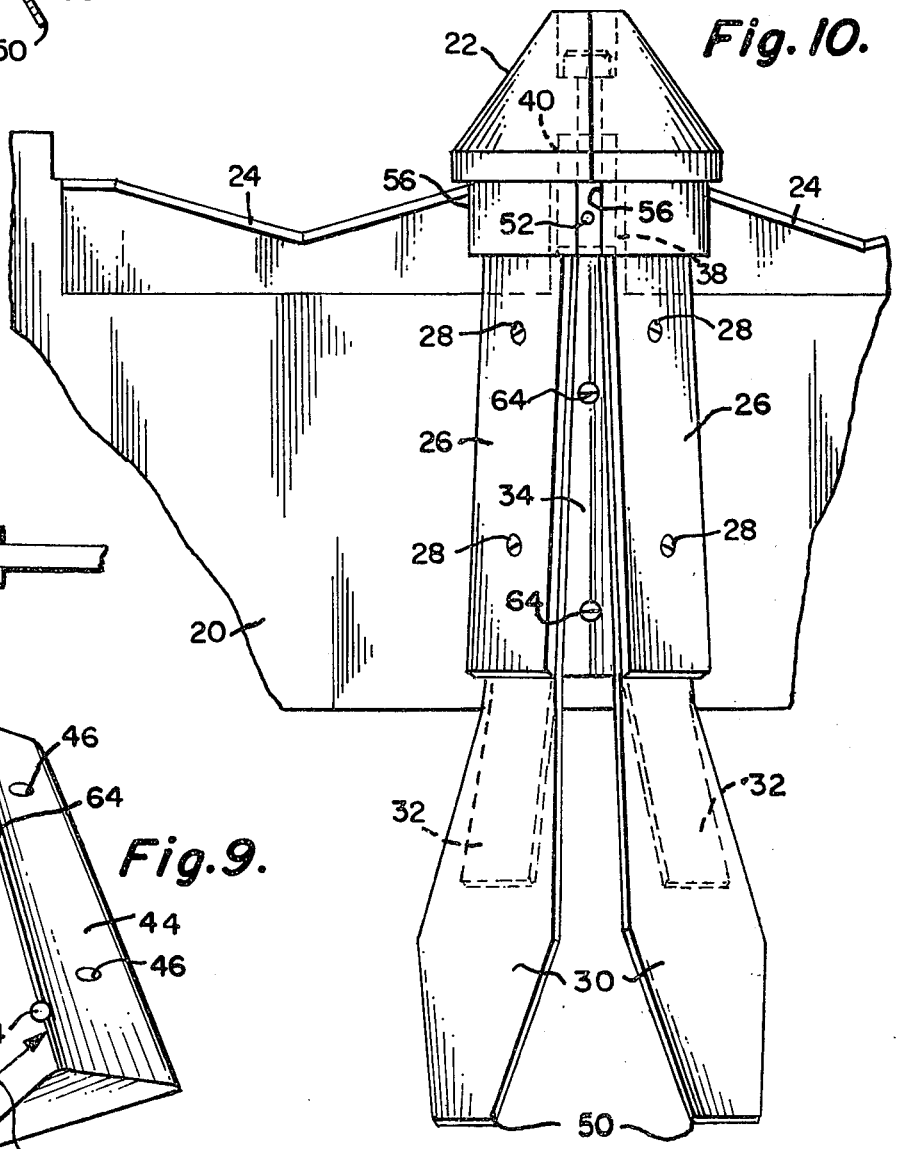
FIG. 10 is a front view of the finally assembled deflector, covers and fingers of an embodiment of the present invention.

The configuration of finger mounting blocks 34 is illustrated in FIG. 9. As shown in this drawing the distance X is longer than the distance Y which shows the taper away from partition 20 of the guide surfaces 44. The amount of downwardly directed and outwardly extending taper may be varied in accordance with the particular application to which the bottling apparatus is to be utilized. However with most standard bottle sizes and weights, a single manufactured finger block structure will be sufficient. As shown in the exploded view in FIG. 2 the preferable configuration includes the finger mounting block 34 secured to partition 20. A cover member 26 is then secured by screws 28 into cover screw receiving hole 46 defined within the block 34. Retained between the cover 26 and the finger block 34 will be the finger 30 and the flat spring biasing means 32. With this secure configuration attached to each guiding surface 44 of each finger block 34 a well defined array of bottles will be guided into the individually defined cells.

To prevent chipping due to glass to metal contact the present invention will preferably use nylon inserts 24, nylon deflectors 22, nylon fingers 30 as well as nylon covers 26. Also the screws 28 will most desirably be slightly depressed into cover 26 to eliminate contact between the screws and the downwardly moving bottle 60. This entire design will therefore provide a smooth guiding face for directing the downwardly moving neck-down bottles into orientation within the individual cells without allowing any glass to metal contact and thereby preventing chipping of the bottles 60.

While particular embodiments of this invention have been shown in the drawings and described above, it will be apparent that many changes may be made in the form, arrangement and positioning of the various elements of the combination. In consideration thereof, it sould be understood that preferred embodiments of this invention disclosed are intended to be illustrative only and not intended to limit the scope of the invention.

I claim:

1. A neck-down bottle packing grid which eliminates metal to glass contact between the packing apparatus and the glass bottles which comprises:

a. a plurality of partitions extending approximately parallel with respect to one another;

b. a plurality of guide block mounts positioned at approximately equal distances along the upper edges of said partitions;

c. a plurality of guide blocks of soft material mounted upon said guide block mounts;

d. a plurality of finger blocks secured to said partitions and extending downwardly from each of said guide blocks on opposite sides of said partitions, said finger blocks including two outwardly facing guide surfaces being tapered obliquely from said partition to which said finger block is secured to define in combination with said guiding surfaces of adjacent finger blocks a plurality of bottle receiving cells;

e. a plurality of covers of soft material secured to said guide surfaces of said finger blocks to be similarly tapered obliquely away from said partitions;

f. a plurality of fingers of soft material secured to said guide surfaces of said finger blocks, said fingers including lower sections extending obliquely inwardly toward the center of said cells to guide downwardly falling bottles into individual orientation within individual cells;

g. a plurality of inserts of soft material secured at the upwardly disposed edges of said partitions and extending from each guide block on one of said partitions to each adjacent guide block on said partition; and h. a plurality of insert retaining means adjacent said partition to hold said inserts in fixed relationship along the upper edges of said partitions.

2. The grid as defined in claim 1 wherein said guide blocks are of pyramidal configuration and present surfaces inclined outwardly from said partition toward adjacent cells.

3. The grid as defined in claim 1 wherein said inserts are of soft nylon.

4. The grid as defined in claim 1 further comprising a plurality of guide block bases fixedly secured to said partitions below said guide blocks said guide block mounts each being movably secured to said guide block bases.

5. The grid as defined in claim 4 further including a pin extending through each said guide block base and each said guide block mount for pivotally movable attachment therebetween.

6. The grid as defined in claim 1 wherein the upper edges of said inserts slope downwardly from each adjacent guide block to present a downwardly facing V-shaped cross-section.

7. The grid as defined in claim 1 wherein the upper edges of said inserts present an inverted V-shaped lateral cross-section to facilitate urging of downwardly moving bottles into adjacent cells and to minimize impact between the bottles and the upper edges of said inserts.

8. The grid as defined in claim 1 further including biasing means adjacent said fingers to urge said fingers inwardly toward said cells.

9. The grid as defined in claim 8 wherein said biasing means comprises a flat spring in abutment with the undersurface of said fingers at one end and fixedly secured to said finger block at the other end.

10. The grid as defined in claim 1 wherein said insert defines a groove therein to receive the upper edge of said partition and provide secure attachment therebetween.

11. The grid as defined in claim 1 wherein said insert is formed with a lateral width larger than the lateral width of said partition to eliminate contact between the downwardly moving bottle and said partitions.

12. The grid as defined in claim 1 wherein said guide blocks define vertical slots therein adjacent the edges of said partitons, said slots adapted to receive the ends of said inserts therein to secure said inserts in place above said partitions.

13. The grid as defined in claim 1 wherein said retaining means includes a plate member fixedly secured to each side of each said guide block bases and extending over said inserts and above the upper edge of said partitions to hold said inserts in position.

14. A neck-down bottle packing grid which eliminates metal to glass contact between the packing apparatus and bottles which comprises:

a. a plurality of partitions extending parallel with respect to one another to define an array of cells for receiving inverted bottles and the like;

b. a plurality of guide block mounts approximately equally spaced along said partitions and movably secured thereto;

c. a plurality of nylon guide blocks mounted upon each of said mounts, said guide blocks defining vertical slots therein adjacent the upper edges of said partitions;

d. a plurality of finger blocks secured to both sides of said partitions adjacent said guide blocks and extending downwardly therefrom, said finger blocks including two outwardly extending guide surfaces being tapered downwardly and obliquely outwardly from the top edge of said partitions, in combination with said partitions said guide surfaces defining said bottle receiving cells;

e. a plurality of nylon covers secured to said guide surfaces of said finger blocks to be similarly tapered downwardly and obliquely outwardly from said guide blocks f. a plurality of flexible nylon fingers secured to said guide surfaces of said finger blocks, said fingers extending downwardly and inwardly toward said cells to urge downwardly moving inverted bottles into orientation within said adjacent cells;

g. flat spring means fixedly secured to said finger blocks and in abutment with said fingers to urge same toward the centers of said cells; and h. a plurality of nylon inserts secured at the upwardly disposed edges of said partitions and extending from each guide block on one of said partitions to each adjacent guide block on said partition, said inserts extending into said vertical slots of adjacent guide blocks to secure said inserts in position above the upper edges of said partitions, said inserts including an upper edge tapering downwardly away from each adjacent guide block to form an upwardly facing V-shaped cross-section, said inserts presenting an inverted V-shaped lateral cross-section to facilitate urging of downwardly moving bottles into adjacent cells and out of contact with said partition.

* * * * *